United States Patent [19]

Auck

[11] 4,229,213

[45] Oct. 21, 1980

[54] HYDROMETALLURGICAL RECOVERY OF NICKEL VALUES

[75] Inventor: Yoon T. Auck, Tucson, Ariz.

[73] Assignee: UOP Inc., Des Plaines, Ill.

[21] Appl. No.: 36,486

[22] Filed: May 7, 1979

[51] Int. Cl.[3] ..... C22B 23/04

[52] U.S. Cl. ..... 75/103; 75/1 R; 75/7; 75/82; 75/111; 75/119; 423/138; 423/150

[58] Field of Search ..... 75/1 R, 7, 82, 103, 75/111, 119; 423/138, 150

[56] References Cited

U.S. PATENT DOCUMENTS

| | | | |
|---|---|---|---|
| 3,100,700 | 8/1963 | Hills | 75/103 X |
| 3,655,364 | 4/1972 | Evans et al. | 75/103 |
| 3,772,423 | 11/1973 | Stevens et al. | 75/119 X |
| 3,772,424 | 11/1973 | Stevens et al. | 75/119 X |
| 3,845,189 | 10/1974 | Miller et al. | 75/119 X |
| 3,860,689 | 1/1975 | Setton et al. | 75/119 X |
| 3,985,556 | 10/1976 | Siemens et al. | 75/82 X |

*Primary Examiner*—G. Ozaki

*Attorney, Agent, or Firm*—James R. Hoatson, Jr.; Raymond H. Nelson; William H. Page, II

[57] ABSTRACT

The recovery of metal values such as nickel from a metal bearing source such as lateritic ores in which the metal bearing source is subjected to a reductive roast at an elevated temperature in the range of from about 700° to about 1300° F. in contact with at least one additive and thereafter extracting the metal bearing source in an ammoniacal solution whereby the desired metal such as nickel is leached out and recovered, the yield of the desired metal may be increased by subjecting the source to an annealing process during the reductive roast thereof.

9 Claims, No Drawings

HYDROMETALLURGICAL RECOVERY OF NICKEL VALUES

BACKGROUND OF THE INVENTION

In the processing of materials containing metal values, two of the main extractive methods to be considered are pyrometallurgy and hydrometallurgy. In the former, metal-containing material such as ore, slag, scrap, etc., is heated with appropriate agents such as reducing agents, fluxing agents, sulfidizing agents, chloridizing agents and/or oxidizing agents, etc., usually to the melting or fusion point of the mixture. At this temperature there is generally a separation of metallic values from gangue or waste materials. The procedure then calls for separating the metallic values from slag or waste material at a temperature at which both are molten. The phase containing the metal value is then cast to some convenient shape for use or for further refining, whichever is appropriate for the particular system involved. The very high temperatures involved in this technique are achieved via electric furnaces, blast furnaces, reverberatory furnaces, etc. Temperatures required for metals such as copper, nickel, iron would generally range from 2000° to 3000° F. An advantage in this method is that recoveries of the metal values are typically quite high.

The hydrometallurgy approach differs substantially from pyrometallurgy in that, although the metal bearing material such as ore, slag, scrap, etc., may be heated with agents such as reducing agents, oxidizing agents, sulfidizing anc chloridizing agents as part of the procedure, the temperatures involved are generally much lower than with the usual pyrometallurgical method. These temperatures typically may be 500° to 1900° F., temperatures generally well below the fusion point of the metal-containing material.

Following this step, the treated metal-containing material then is contacted with an appropriate aqueous solution for extracting metal values by dissolution. The metal is then removed from the solution by precipitation, solvent extraction, evaporation of solvent, etc. The metal-containing residue obtained is then handled appropriately to further refine the metal. Although conditions of temperature are generally much lower than in pyrometallurgy, it is frequently found that recovery of the metal values is also lower than in the pyrometallurgical method.

A particular case where this is true concerns the extraction of nickel from lateritic nickel ores. The pyrometallurgical processes range from the use of an electric furnace for the direct smelting of ore to produce ferronickel through similar techniques involving the blast furnace in which an iron-nickel-sulfide matte is obtained. The extraction of nickel from the ore using this method is greater than 90%.

Of the several hydrometallurgy approaches used commercially for treating this type of ore, the practice on a highly serpentinic ore, such as at Nicaro, Cuba, involves roasting the ore in a multihearth furnace while a reducing gas, such as producer gas, passes countercurrent to the ore. Temperatures in this case range from about 900° to about 1350° F. Following the roasting step, the ore is cooled in the absence of air, mixed with an ammoniacal ammonium carbonate solution and vigorously agitated and aerated. This results in the dissolution of nickel and cobalt, separating them from the bulk of the ore. This solution then is treated with steam, driving off ammonia and precipitating nickel carbonate. This product then is treated further to obtain the appropriate form of nickel or used as such. In comparison to the pyrometallurgical process, however, extractions using this method have only been of the order of 70 to 80%.

Several other hydrometallurgy methods involve the use of procedures which include a roasting step with chlorides or sulfates but in other than reducing atmospheres, and the roasted ore is leached with an appropriate solvent such as dilute sulfuric acid. Alternatively, in certain cases the ore can be leached directly, such as with sulfuric acid solution but this is practical only when the magnesia content of the ore is low and when leaching conditions of high temperature, high pressure and high acid concentrations are used.

As examples of processes for the hydrometallurgical recovery of metal values, U.S. Pat. Nos. 3,772,423, 3,772,424 and 3,845,189 disclose the treatment of metal bearing sources with various additives such as hydrogen chloride, gaseous sulfur, sulfur dioxide, elemental sulfur, etc., either alone or in combination prior to subjecting the treated metal bearing source to a roast which is effected in contact with a reducing gas. Following the reductive roast which is effected at temperatures ranging from about 1000° to about 1800° F., and preferably in a range of from about 1200° to about 1600° F., the metal source is cooled and thereafter the source is subjected to a leaching step in the presence of an ammoniacal ammonium carbonate solution whereby the source is processed in a conventional manner for the hydrometallurgical extraction of the desired metal such as nickel. However, in these patents the temperature of the reductive roast is continuously increased over the period of the roast, usually being increased in a predetermined number of degrees per minute.

As will hereinafter be shown in greater detail, it has now been discovered that by subjecting the metal bearing source to an annealing temperature of a predetermined period of time at some point during the reductive roast, it is possible to obtain desirable yields of metals such as nickel.

This invention relates to a method for the hydrometallurgical recovery of metal values from a metal bearing source. More specifically, the invention is concerned with a method for the hydrometallurgical recovery of nickel from a nickel bearing source containing a mixture of many metals. The recovery of a metal such as nickel may be facilitated by utilizing an annealing process during the reductive roast of the metal bearing source.

It is therefore an object of this invention to provide an improved method for the hydrometallurgical recovery of metal values from a metal bearing source.

Another object of this invention is to provide a process whereby improved yields of a desired metal such as nickel may be recovered from a metal bearing ore.

In one aspect an embodiment of this invention resides in a method for the recovery of nickel from a nickel bearing source which comprises treating said source with at least one additive selected from the group consisting of hydrogen halide and a sulfur containing compound, subjecting said treated source to a reductive roast in contact with a reducing gas at a temperature in the range of from about 700° to about 1300° F., maintaining an annealing temperature at a constant degree for a predetermined period of time during said roast, cooling said source upon completion of said roast, extracting the cooled source with an ammoniacal ammonium compound, and recovering the desired nickel.

A specific embodiment of this invention is found in a method for the recovery of nickel from a nickel bearing source which comprises treating said source with hydrogen chloride and elemental sulfur, subjecting the treated source to a reductive roast in contact with a reducing gas at a temperature in the range of from about 700° to about 1300° F., maintaining an annealing temperature at a constant degree for a period of time in the range of from about 1 minute to about 20 minutes during said roast, cooling said source upon completion of said roast, extracting the cooled source with an ammoniacal ammonium carbonate or sulfate solution, and recovering the desired nickel.

Other objects and embodiments will be found in the following further detailed description of the present invention.

As hereinbefore set forth the present invention is concerned with an improvement in the process for extracting metal values and particularly nickel values from a metal bearing source by using an improved hydrometallurgical process. It has now been discovered that an improved extraction of metal values is obtained when employing a hydrometallurgical process by effecting the reductive roast in such a way so that an annealing process or annealing time may be applied during said roasting period thus permitting the use of a substantially lower temperature than the temperature which is ordinarily used in hydrometallurgical processes. By being able to utilize this lower roast temperature, the entire process may be enhanced in that there will be a net saving in the energy requirements, a considerably lesser risk on the over-reduction of ores such as nickel bearing laterite ores, and less capital cost requirement inasmuch as the annealing time essentially reduces the total residence time requirement for the roasting step of the process.

As hereinbefore set forth the present invention is concerned with a method for the hydrometallurgical recovery of metal values from a metal bearing source. The term "metal bearing source" as used in the present application and appended claims will refer to sources such as ore, slag, scrap, etc. In the interest of brevity, it is to be understood that reference to ore in the present specification will also include reference to the other metal bearing sources hereinbefore set forth. The improved process for the recovery of a desired metal value is particularly applicable to the recovery of nickel from such sources. However, it is to be understood that the process may also be used for the recovery of other metal values including, for example, copper, cobalt, manganese, etc.

The hydrometallurgical recovery of metal values may be effected utilizing conventional apparatus and in addition may utilize some conventional steps which have been set forth in prior art processes. Accordingly, the ore such as a lateritic nickel ore or other metal bearing source is first prepared in a manner suitable for the process, whereby the ore is subjected to treatment in order to form finely divided or comminuted particles, said grinding or other treatment being any which are well known in the art. The particles may be within a size range of from 35 to about 325 mesh and preferably within a range of from about 48 to about 200 mesh. The other ground particles are then dried in a conventional manner in order to lower the moisture content of said particles of from about the usual 25 to 50% down to about 8 to 10% or less. The drying step is generally effected by treating the particles in a rotary kiln at conventional temperatures.

Following the drying of the particles, said particles are then subjected to a roast in the presence of a reducing gas or atmosphere at temperatures in the range of from about 700° up to about 1300° F., said roasting being effected while the metal bearing source or particles are in contact with at least one additive, the presence of said additive preventing the incorporation of the desired metal such as nickel which will make it unavailable and in addition the additive will at a later point enable the nickel to be recovered from the extraction step in a higher percentage. By roasting the ore in a reducing atmosphere in the presence of additives at this temperature, the magnesium compounds which are present will be prevented from converting to magnesium silicate in the form of forsterite, which formation usually acts to reduce the content of the nickel extractable forms. The reducing zone in which the ore is roasted may be of conventional nature and may include, for example, a multihearth furnace, a fluo-solids roaster, a Herreshoff furnace, etc. The reduction of the ore is effected by means of a suitable reducing gas mixture which, if so desired, may be of the general type which is used in conventional processes. Any suitable reducing gas mixture may be used and preferably comprises a mixture of hydrogen, carbon monoxide, carbon dioxide and water vapor. The gaseous mixture may come from any suitable source such as producer gas, gases formed by the combustion of city gas, gases formed by combustion of oil, etc. The specific gaseous mixture will be selected to effect the desired reduction of the nickel compounds to an extractable state. As an example, an illustrative gas mixture comprises a $CO:CO_2$ ratio within the range of from about 0.1:1 to 10:1, a $CO:H_2$ ratio of from about 0.1:1 to 10:1 and a $H_2:H_2O$ vapor ratio of from about 1.1:1 to 10:1, all being on a volumetric basis. In one embodiment, it is desirable to maintain the gas mixture within the ratios set forth above because an excessive concentration of one or more of the components in the gas mixture may have undesired effects such as, for example, incomplete reduction of the metal compound to the metallic state, excessive absorption of the gas in the ore particles, etc. It is to be understood that the gas mixture may contain other components as, for example, nitrogen, when advantages appear therefor. Other illustrative gas mixtures comprise hydrogen, nitrogen and water vapor or natural gas.

As hereinbefore set forth the roasting of the ore in the reducing atmosphere is also accomplished by contacting the ore with an additive. Examples of additives which may be used include hydrogen halide gas such as hydrogen chloride gas, hydrogen bromide gas, hydrogen iodide gas, or hydrogen fluoride gas, the latter two being used but not necessarily with equivalent results. The concentration of hydrogen halide gas which is used will be in a range of from about 0.001 to about 2%, and preferably from about 0.01 to about 1.5% by weight of the ore. In the event that hydrogen halide gas such as hydrogen chloride is used as the additive, it may be added in any suitable manner including direct addition to the hydrogen halide gas into the roasting zone, stripping of the hydrogen halide from a solution thereof, etc. In one preferable method, the reducing gas of the composition hereinbefore set forth is bubbled through an aqueous solution of the hydrogen halide and thus the hydrogen halide gas is carried into the reducing zone in this manner, preferably with preheating prior to charging said mixture into the reducing zone. The solution of hydrogen halide may range from 1% to saturated (37%) or even supersaturated, with a constant boiling solution containing 23% hydrogen chloride being of particular advantage in order to serve as a convenient control of the concentration of the hydrogen halide being added to the roasting zone. In another embodiment, the free halogen such as chlorine, bromine, etc., may be injected directly into the roasting zone wherein, upon contact with the reducing gas, it will be rapidly converted to the corresponding hydrogen halide.

Other methods of introducing precursors of hydrogen halide into the roasting zone and thereafter converting these precursors to hydrogen halide will include the use of precursors such as boron trichloride, boron tribromide, boron trifluoride, carbon tetrachloride, carbon tetrabromide, carbon tetrafluoride, phosphorus tribromide, phosphorus pentabromide, phosphorus trichloride, phosphorus pentachloride, phosphorus trifluoride, phosphorus pentafluoride, phosphorus triiodide, silicon tetrabromide, silicon tetrachloride, silicon tetrafluoride, silicon tetraiodide, methyl chloride, methylene chloride, methyl bromide, methylene bromide, methyl fluoride, methylene fluoride, methyl iodide, ethyl chloride, dichloroethylene, dibromoethylene, vinyl chloride, vinyl bromide, vinyl fluoride, vinyl iodide and higher molecular weight hydrocarbyl halides which generally will not contain more than about 20 carbon atoms per molecule. At the high temperatures encountered in the roasting step, the precursor will be decomposed to liberate the hydrogen halide or the halogen which is soon reduced to the hydrogen halide form. When desired, a mixture of the hydrogen halides and/or precursors may be employed.

Other additives which may be employed will include sulfur or sulfur compounds. The sulfur may be in gaseous form or may be in solid form including powder, flour, granules, pellets, etc., or molten or otherwise liquefied sulfur. Examples of sulfur-containing compounds will include pyrite ($FeS_2$) or the xanthates including methyl xanthate, ethyl xanthate, propyl xanthate, butyl xanthate, pentyl xanthate, hexyl xanthate, etc. or metal salts thereof such as sodium methyl xanthate, potassium methyl xanthate, calcium methyl xanthate, sodium ethyl xanthate, potassium ethyl xanthate, calcium ethyl xanthate, sodium propyl xanthate, potassium propyl xanthate, calcium propyl xanthate, sodium butyl xanthate, potassium butyl xanthate, calcium butyl xanthate, sodium pentyl xanthate, potassium pentyl xanthate, calcium pentyl xanthate, sodium hexyl xanthate, potassium hexyl xanthate, calcium hexyl xanthate, etc. When utilizing sulfur as the additive, the sulfur may be admixed with the air at an elevated temperature with the particles which are being withdrawn from the drying step. The sulfur is usually present in an amount ranging from a concentration of from about 0.1 to about 5% and preferably from about 0.15 to about 3% by weight of the ore. It is to be understood that any suitable means of introducing the sulfur into the reducing zone may be utilized. In addition, it is also contemplated within the scope of this invention that a combination of additives may be employed, such combinations including hydrogen halide, added sulfur in solid form and/or gaseous sulfur.

As hereinbefore set forth, it is possible to obtain improved yields of metal values when the roasting of the metal bearing source is effected while utilizing an annealing time at appropriate annealing temperatures. By utilizing this annealing time, it is possible to shorten the overall roasting period of the source while also utilizing lower roasting temperatures. The roasting of the metal value source is accomplished by placing the ore in a roaster of the type hereinbefore set forth in greater detail at a temperature of about 700° F. and thereafter raising the temperature at a predetermined rate until the maximum temperature is achieved. For example, in one embodiment the temperature of the roaster is raised at a rate of about 25° F. per minute until the aforesaid upper limit is reached and thereafter the metal source is quenched. However, it has now been discovered that by maintaining the temperature at a predetermined degree for an annealing time, it is possible to obtain higher recovery of the desired metal values. For example, in one embodiment, the temperature may be raised from about 700° F. to 1200° F. and maintained at that temperature for an annealing time which may range from 1 to about 20 minutes in duration and preferably from about 2 to about 12 minutes in duration. Thus, the total roast time may be considerably shorter than the typical requirement of greater than 1 hour which is used in prior processes. While in one embodiment the annealing time is used when the maximum temperature is reached, it is also contemplated within the scope of this invention that the annealing time may be effected at an intermediate temperature point. For example, the temperature of the roast may be raised from 700° to about 1000° F. and maintained thereat for a period of time ranging from about 2 to about 12 minutes and thereafter the temperature may be raised to 1300° F. for an additional period of time before effecting the quench or cooling of the metal value source. Likewise, in another embodiment, the annealing step of the process may be effected by raising the temperature of the roast from about 700° to about 1000° F., annealing the metal value source for a period of time ranging from about 2 to about 4 minutes, thereafter raising the temperature to about 1100° F. and effecting the second annealing step whereby the temperature is maintained at this level for a period of from about 4 to about 6 minutes, and thereafter raising the temperature to the upper limit of the aforesaid range prior to quenching.

By utilizing this annealing step in the roasting process, it is possible to effect the roast at a considerably lower temperature than was heretofore used, for example, using roasting temperatures up to about 1800° F., thus effecting a savings in the energy requirement as well as the type of equipment which must be used for these considerably higher temperatures.

The reduced ore particles after termination of the solid reductive roast are withdrawn from the reducing zone and processed in a conventional manner for the hydrometallurgical extraction of nickel, cobalt or other metal values. The effluent from the reduction zone is first cooled several hundred degrees and then is passed into one or more quench zones. In a preferred embodiment the quench liquid is the ammonium carbonate leaching solution. However, the quenching must be effected in the absence of air. In other words, oxygen or air should not contact the reduced particles until the temperature of the particles is below about 200° F. because of the possibility of oxidation of the metal to the oxide or to other oxygen containing compounds. It is understood that other suitable quenching solutions may be employed but, as hereinbefore set forth, economical advantages appear for the use of the leaching solution.

Any suitable leaching solution may be employed and preferably comprises aqueous ammonium carbonate solution containing from about 2% to about 25% and preferably from about 3% to about 15% $NH_3$ and from about 1% to about 15% and preferably from about 1.5% to about 7.5% $CO_2$. As still another advantage to the process of the present invention, the leaching solution comprises a lower concentration of $NH_3$ than generally is utilized in the prior art, thus effecting an additional economy in the present process. The leaching is effected at a temperature below 200° F. and conveniently ambient temperature. Ambient pressure or superatmospheric pressure may be used but generally will not exceed about 100 psig. As hereinbefore set forth, the leaching is effected in the presence of oxygen, which may comprise ambient air when the leaching is effected in open tanks or vessels or it may comprise air introduced into closed zones. It is understood that, in the place of air, oxygen or other suitable oxygen containing source may be utilized.

The extraction of the desired metal value such as nickel is effected in any suitable manner and generally by passing the metal bearing source or ore countercurrently to the leaching solution in a plurality of leaching and thickening zones. The solution of nickel or other metal is withdrawn from the leaching and thickening zones and then treated in any suitable manner to precipitate the desired metal and recovering the same. In one method, this is accomplished by steaming to precipitate nickel carbonate and to volatilize off ammonia, carbon dioxide, and water.

The following examples are given to illustrate the process of the present invention. However, it is to be understood that these examples are given merely for purposes of illustration and that the invention is not necessarily limited thereto.

EXAMPLE I

In this example a series of experimental runs were performed utilizing a Greek lateritic nickel ore having the following assay:

| | Percent |
|---|---|
| Ni | 1.02 |
| Co | 0.05 |
| Fe | 34.9 |
| MgO | 2.62 |
| $SiO_2$ | 30.3 |

In the various runs 25 grams of the lateritic ore were weighed into a tared $\frac{7}{8}$" I.D. quartz combustion tube, purged with reducing gas to eliminate any oxygen which may have been contained in the tube, and thereafter placed into a split tube furnace at a temperature of 700° F. A reducing gas was passed over the sample while the temperature was increased from 700° F. to 1300° F. at a heating rate of 25° F. per minute. The composition of the gas which was used for the reducing roast was as follows:

| Gas | cc/Min. |
|---|---|
| $H_2$ | 405 |
| CO | 384 |
| $CO_2$ | 120 |
| $N_2$ | 840 |
| $H_2O$ | 480 |

The aforementioned reducing gas was passed through a bubbler to add water vapor prior to being charged into the combustion tube.

When the temperature in the reducing zone had been increased to 1300° F., the temperature was maintained at this figure for a series of annealing times. The annealing times which were used comprised 2 minutes, 4 minutes and 8 minutes respectively. At the end of each of these periods of time the gas mixture was replaced by a flow of nitrogen and the tube was cooled to room temperature. Upon reaching room temperature the reduced ore was then weighed, transferred in a nitrogen atmosphere and slurried with 200 ml of an ammoniacal ammonium carbonate solution. The slurry was agitated vigorously at ambient temperature for a period of 2.5 hours and filtered. The filtrate was then assayed for nickel content to determine the percent of extraction of nickel. The results of the extraction based upon the various annealing times in which the annealing step was run at 1300° F. are set forth in Table I below.

TABLE I

| Annealing Time, Minutes | Percent Nickel Extraction |
|---|---|
| 2 | 72.9 |
| 4 | 80.0 |
| 8 | 85.8 |

It is therefore noted from the above table that an increased amount of annealing time at a relatively low reducing temperature of 1300° F. increased the percent of nickel which was extracted from the solution and which could be recovered.

EXAMPLE II

In order to illustrate the advantage of using an annealing time at the aforesaid relatively low temperature of 1300° F., a second series of runs were performed utilizing the process set forth in Example I above. In the first run the ore was reduced in a roast which began at an initial temperature of 700° F. and rose to 1600° F. at a rate of 25° F. per minute. Upon reaching 1600° F., the temperature was mainained thereat while the ore was annealed for a period of 8 minutes. Following this the tube was cooled to room temperature, the ore was slurried with ammoniacal ammonium carbonate solution in a manner similar to that set forth in Example I above, filtered, and the filtrate was assayed to determine the amount of nickel extracted.

In the second run the procedure was repeated, the only difference being that upon reaching 1500° F. the annealing period was applied. The third run reached only 1400° F. before annealing for 8 minutes while in the fourth run the maximum temperature utilized was 1300° F. for an annealing period of 8 minutes. The result of the assay on the four runs is set forth in Table II below.

TABLE II

| Temperature, °F. | Percent Nickel Extraction |
|---|---|
| 1600 | 61.9 |
| 1500 | 75.4 |
| 1400 | 83.9 |
| 1300 | 85.8 |

It is noted from the above data that a reduction in the operating temperature in the presence of a relatively short annealing time will result in an improved recovery of the nickel and also will result in a significantly lower requirement of energy to obtain the desired result.

I claim as my invention:

1. A method for the recovery of nickel from a nickel bearing source which comprises treating said source with at least one additive selected from the group consisting of hydrogen halide and a sulfur containing compound, subjecting said treated source to a reductive roast in contact with a reducing gas at a temperature in the range of from about 700° to about 1300° F., maintaining during said roast an annealing temperature at a constant degree for a period of time of from about 1 to about 20 minutes, cooling said source upon completion of said roast, extracting the cooled source with an ammoniacal ammonium compound, and recovering the desired nickel.

2. The method as set forth in claim 1 in which said ammoniacal ammonium compound is ammoniacal ammonium carbonate.

3. The method as set forth in claim 1 in which said ammoniacal ammonium compound is ammoniacal ammonium sulfate.

4. The method as set forth in claim 1 in which said hydrogen halide is present in a concentration of from about 0.001% to about 2% by weight of said nickel bearing source.

5. The method as set forth in claim 4 in which said hydrogen halide is hydrogen chloride.

6. The method as set forth in claim 1 in which said sulfur containing compound is present in a concentration of from about 0.1% to about 5% by weight of said nickel bearing source.

7. The method as set forth in claim 6 in which said sulfur containing compound is gaseous sulfur.

8. The method as set forth in claim 6 in which said sulfur containing compound is elemental sulfur.

9. The method as set forth in claim 1 in which said nickel bearing source is a lateritic ore.

* * * * *